US007861766B2

(12) United States Patent
Bochiechio et al.

(10) Patent No.: US 7,861,766 B2
(45) **Date of Patent: *Jan. 4, 2011**

(54) METHOD FOR FIRING A CERAMIC AND REFRACTORY METAL CASTING CORE

(75) Inventors: Mario P. Bochiechio, Vernon, CT (US); Steven J. Bullied, Pomfret Center, CT (US); Lea D. Kennard, Manchester, CT (US); Carl R. Verner, Windsor, CT (US); John J. Marcin, Jr., Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 892 days.

This patent is subject to a terminal disclaimer.

(21) Appl. No.: 11/402,164

(22) Filed: Apr. 10, 2006

(65) Prior Publication Data

US 2007/0235158 A1 Oct. 11, 2007

(51) Int. Cl.
*B22C 9/04* (2006.01)

(52) U.S. Cl. ..... 164/516; 164/28

(58) Field of Classification Search ..... 164/28, 164/369, 516

See application file for complete search history.

(56) References Cited

U.S. PATENT DOCUMENTS

| | | | | |
|---|---|---|---|---|
| 5,338,509 | A | 8/1994 | Coupland et al. | |
| 5,394,932 | A | 3/1995 | Carozza et al. | |
| 6,637,500 | B2 | 10/2003 | Shah et al. | |
| 6,929,054 | B2 | 8/2005 | Beals et al. | |
| 6,951,239 | B1 | 10/2005 | Snyder et al. | |
| 7,174,945 | B2 | 2/2007 | Beals et al. | |
| 2003/0015308 | A1 * | 1/2003 | Fosaaen et al. | 164/35 |
| 2003/0062145 | A1 * | 4/2003 | Frasier et al. | 164/122.1 |
| 2004/0020629 | A1 | 2/2004 | Shah et al. | |
| 2005/0133193 | A1 * | 6/2005 | Beals et al. | 164/516 |
| 2007/0089850 | A1 | 4/2007 | Beals et al. | |
| 2007/0144702 | A1 | 6/2007 | Wiedemer et al. | |

FOREIGN PATENT DOCUMENTS

| | | | |
|---|---|---|---|
| EP | 1524045 | A2 | 4/2005 |
| JP | 1-99745 | A | 4/1989 |
| JP | 2003-170245 | A | 6/2003 |
| JP | 2005-297067 | A | 10/2005 |

OTHER PUBLICATIONS

Partial translation of Japanese Office Action for JP2007102297, dated Jun. 30, 2009.

* cited by examiner

*Primary Examiner*—Kuang Lin
(74) *Attorney, Agent, or Firm*—Bachman & LaPointe, P.C.

(57) ABSTRACT

In an investment casting process, a composite core is formed as a combination of ceramic casting core element and a non-ceramic casting core element. The core is heated in an oxidative atmosphere and then heated in a non-oxidative atmosphere.

18 Claims, 2 Drawing Sheets

METHOD FOR FIRING A CERAMIC AND REFRACTORY METAL CASTING CORE

BACKGROUND OF THE INVENTION

The invention relates to investment casting. More particularly, it relates to the investment casting of superalloy turbine engine components.

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective.

Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The ceramic cores themselves may be formed by molding a mixture of ceramic powder and binder material by injecting the mixture into dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al. and U.S. Pat. No. 6,929,054 of Beals et al (the disclosures of which are incorporated by reference herein as if set forth at length) disclose use of ceramic and refractory metal core combinations.

SUMMARY OF THE INVENTION

In an investment casting process, a composite core is formed as a combination of ceramic casting core element and a non-ceramic casting core element. The core is heated in an oxidative atmosphere and then heated in a non-oxidative atmosphere.

The heating in the oxidative atmosphere may be effective to achieve binder removal from the ceramic casting core element. However, this heating advantageously is of insufficient temperature and time to adversely damage the non-ceramic casting core element. The second heating may be for a temperature and time effective to fire the ceramic. The non-oxidative atmosphere may thus protect the non-ceramic casting core element from excessive oxidation that would have occurred with a similar heating in an oxidative atmosphere.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
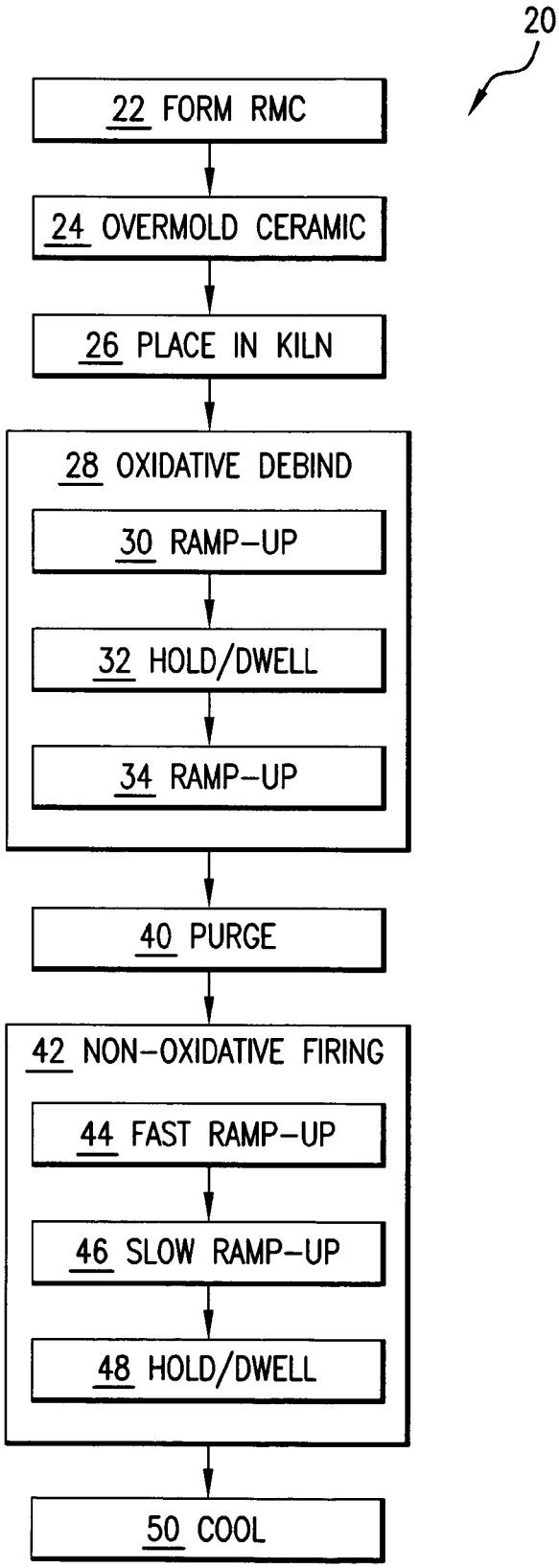
FIG. 1 is a flow chart of a method for forming a composite core assembly.

FIG. 1 shows an exemplary process 20 for forming a composite casting core. One or more refractory metal cores (RMCs) are formed 22. An exemplary formation includes a combination of cutting (e.g., laser cutting or stamping) from a refractory metal sheet (e.g., molybdenum or niobium), forming/shaping (e.g., said stamping or other bending), and coating with a protective coating. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

The RMC(s) are then transferred to a die where a ceramic material (e.g., silica-, zircon-, or alumina-based) is injected/molded 24 over a portion of the RMC(s) to form an initial combination (core assembly). The as-molded ceramic material may include a binder. The binder may function to maintain integrity of the molded ceramic material in an unfired green state. Exemplary binders are wax-based.

The combination is then transferred 26 to a heating chamber (e.g., kiln or furnace). A heating 28 occurs in air and involves increasing the temperature from ambient to a first temperature. The heating 28 vaporizes and purges binder components of the ceramic. The oxidative atmosphere provided by the air may chemically assist in the binder removal process. As is discussed further below, however, excessive heating in such an oxidative atmosphere may potentially damage the RMC(s) with surface irregularities caused by RMC oxidation being potentially transferred to the ultimate cast part. Thus, the first temperature is advantageously low enough to avoid excessive RMC degradation. An exemplary first temperature is 1000° F. More broadly, exemplary first temperatures are in excess of or at least 600° F.; more specifically 800-1200° F. or 900-1100° F. Except where noted, temperatures are the temperatures of the oven or the atmosphere therein rather than temperatures of the core. There may be a moderate lag in core temperature (e.g., up to about 200-300° F.).

The exemplary heating 28 includes a first ramp-up heating 30. The exemplary ramp-up heating 30 may be from ambient conditions (e.g., factory temperature; typically less than 120° F.) to a first intermediate temperature. An exemplary intermediate temperature is 600° F. More broadly, exemplary first temperatures are in excess of 250-950° F.; more specifically 500-800° F. or 550-650° F. The first ramp-up heating 30 may be at relatively high rate (e.g., 10-50° F. per minute, more narrowly 20-40° F. per minute). The first ramp-up heating 30 may be effective to melt/wick or initially decompose the binder.

Following the first ramp-up heating 30, there may be a hold/dwell heating 32. An exemplary hold/dwell heating 32 serves to carbonize remaining binder components/material and remove/evacuate the resulting carbon/ash. An exemplary hold/dwell heating 32 is essentially at said first intermediate temperature.

Following the hold/dwell heating 32, there may be a second ramp-up heating 34. An exemplary second ramp-up heating 34 is to said first temperature and may be at a similar rate.

A purge 40 may precede a main firing heating 42. In an exemplary purge 40, the chamber air is purged with a non-oxidative gas (e.g., nitrogen or argon). The purge gas should be introduced at a slow enough rate to avoid excessive cooling of the core assembly (e.g., to not drop the chamber atmosphere temperature by more than 50° F.). Once the purge gas has essentially replaced the air, the flow rate of such gas may be reduced further to a steady state rate for a remainder of the main firing heating 42.

The exemplary main firing heating 42 is to a firing temperature. An exemplary firing temperature is 2100° F. More broadly, exemplary firing temperatures are in excess of or at least 1600° F.; more specifically 1800-2400° F. or 1800-2000° F. This requires a temperature increase from the temperature at the end of the purge. A first ramp-up heating portion 44 of this increase may be at a relatively high rate (e.g., 10-15° F. per minute). The first portion may occupy a majority of the temperature increase of the main firing heating stage. An exemplary first portion 44 extends until a switchover temperature about 200° F. below (more broadly, 150-300 a second temperature (e.g., a peak temperature which is also said firing temperature). An exemplary ramp-up period is twelve hours, more broadly 8-20 hours and more narrowly 10-15 hours. At the switchover temperature, a second slower ramp-up heating portion 46 (e.g., 1-5° F. per minute) extends essentially to the peak temperature (e.g., 1800-2400° F.).

The composite core may be held/"soaked" 48 at the firing temperature an extended period of time to achieve desired composite core properties. The soaking sinters the ceramic structure causing shrinkage and strength increase to target dimensions and strength properties. An exemplary soak period is eight hours, more broadly 4-12 hours and more narrowly 8-10 hours.

After the soak, there may be a cooldown 50. The cooldown rate should be controlled so that the contraction of the RMC does not get too far ahead of the contraction of the ceramic core and so that purely internal stresses within the ceramic core do not cause fracture. The latter mechanism is particularly significant at lower temperatures and may dictate a slower rate. An exemplary cooldown involves three stages. A first stage is from the soak temperature (e.g., 2000° F.) to a high intermediate temperature (e.g., 1000° F., more broadly, 700-1100° F.). This is at a relatively high rate (e.g., 30-50° F./minute or 40-50°/minute). A second stage is to a low intermediate temperature (e.g., 500° F., more broadly 400-700° F.). This second stage is even slower (e.g., 20-30° F./minute or 20-25°/minute). At the beginning of an exemplary third stage, the heat is shut off and the furnace is vented to atmosphere to re-expose the core to air. However, these two events could be split to further divide the third stage. The coast down cooling of this stage may be yet smaller (e.g., 5-10° F./minute) down to 200° F. or less.

Figure 2:
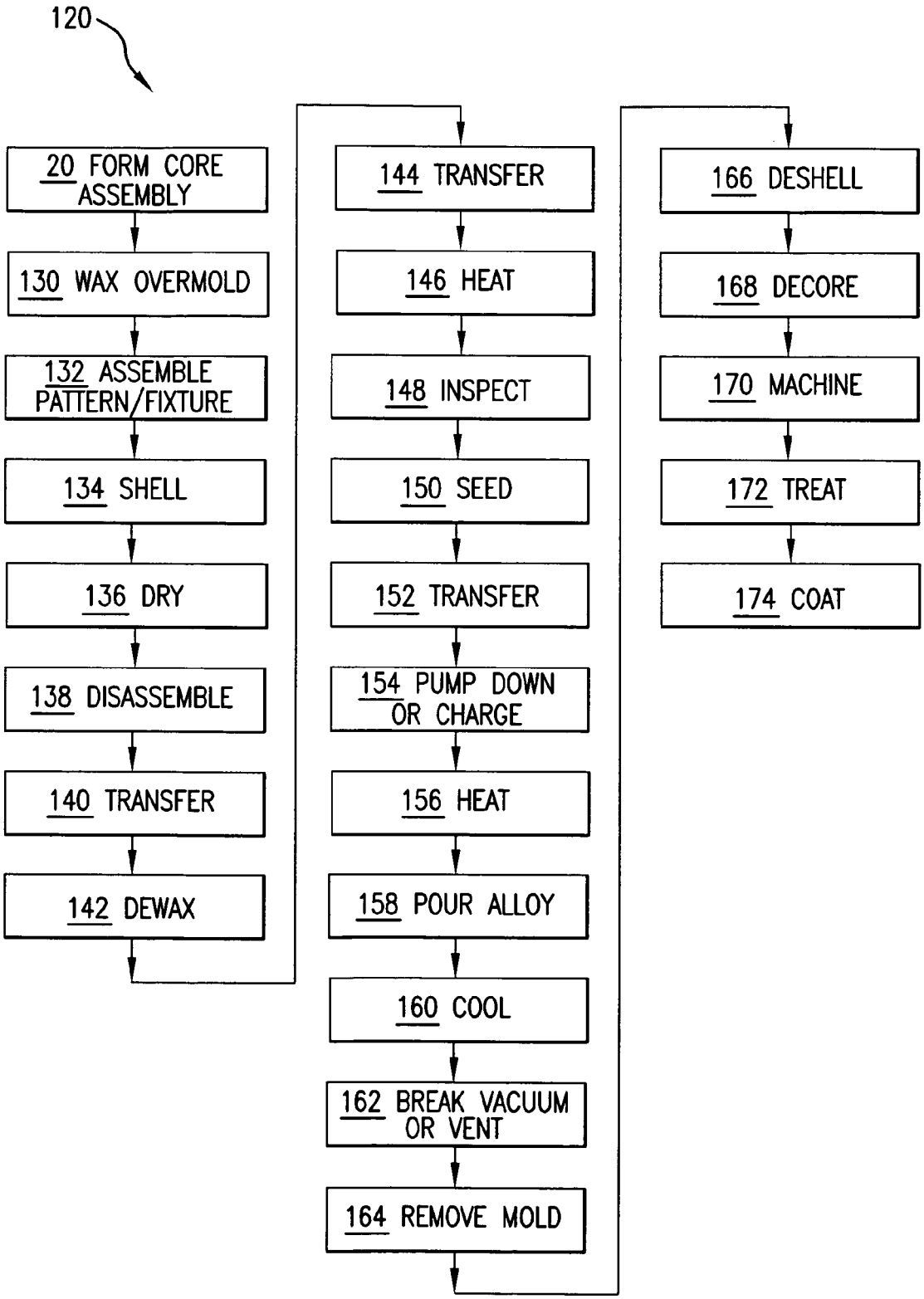
FIG. 2 is a flow chart of a casting process using the composite core assembly.

FIG. 2 shows an exemplary method 120 for investment casting using the composite core assembly. Other methods are possible, including a variety of prior art methods and yet-developed methods. The fired core assembly is then overmolded 130 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 132 to a shelling fixture (e.g., via wax welding between end plates of the fixture). The pattern may then be shelled 134 (e.g., via one or more stages of slurry dipping, slurry spraying, or the like). After the shell is built up, it may be dried 136. The drying provides the shell with at least sufficient strength or other physical integrity properties to permit subsequent processing. For example, the shell containing the invested core assembly may be disassembled 138 fully or partially from the shelling fixture and then transferred 140 to a dewaxer (e.g., a steam autoclave). In the dewaxer, a steam dewax process 142 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 144 to a furnace (e.g., containing air or other oxidizing atmosphere) in which it is heated 146 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 148. The mold may be seeded 150 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred 152 to a casting furnace (e.g., placed atop a chill plate in the furnace). The casting furnace may be pumped down to vacuum 154 or charged with a non-oxidizing atmosphere (e.g., inert gas) to prevent oxidation of the casting alloy. The casting furnace is heated 156 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 158 into the mold and the mold is allowed to cool to solidify 160 the alloy (e.g., after withdrawal from the furnace hot zone). After solidification, the vacuum may be broken 162 and the chilled mold removed 164 from the casting furnace. The shell may be removed in a deshelling process 166 (e.g., mechanical breaking of the shell).

The core assembly is removed in a decoring process 168 to leave a cast article (e.g., a metallic precursor of the ultimate part). The cast article may be machined 170, chemically and/or thermally treated 172 and coated 174 to form the ultimate part. Some or all of any machining or chemical or thermal treatment may be performed before the decoring.

One or more embodiments of the present invention have been described. Nevertheless, it will be understood that various modifications may be made without departing from the spirit and scope of the invention. For example, applied as a modification of an existing process or to the manufacture of an existing part, details of the existing process or part may influence details of any particular implementation. Accordingly, other embodiments are within the scope of the following claims.

What is claimed is:

1. A method comprising:

forming a combination of a ceramic casting core element and a non-ceramic casting core element;

heating the combination in an oxidative atmosphere to a first temperature of the atmosphere of at least 600° F.;

heating the combination in a non-oxidative atmosphere to a second temperature of the atmosphere of at least 1600° F.;

after said heating the combination in said non-oxidative atmosphere to said second temperature, cooling the combination;

after the cooling, overmolding the combination with a wax to form a pattern;

shelling the pattern to form a shell; and removing the wax from the shell.

2. The method of claim 1 wherein:

the forming comprises molding the ceramic casting core element over the non-ceramic casting core element.

3. The method of claim 1 wherein:

the forming comprises shaping the non-ceramic casting core element from refractory metal-based sheet.

4. The method of claim 1 wherein:

the heating in the oxidative atmosphere comprises heating essentially in air; and the heating in the non-oxidative atmosphere comprises heating essentially in at least one of nitrogen and noble gases.

5. The method of claim 1 wherein:

the heating in the oxidative atmosphere comprises:

an initial ramp-up heating to essentially a first hold temperature;

a hold interval essentially at said first hold temperature; and a second ramp-up heating essentially to said first temperature; and the heating in the non-oxidative atmosphere comprises:

a ramp-up heating essentially to said second temperature; and a hold interval essentially at said second temperature.

6. The method of claim 1 wherein:

the heating in the non-oxidative atmosphere comprises a first phase of temperature increase of 10-15° F. per minute over a majority of a range from said first temperature to said second temperature and a later second phase of temperature increase of 1-5° F. per minute over at least 100° F.

7. The method of claim 1 wherein:

the heating in the non-oxidative atmosphere comprises a first phase of temperature increase of 10-15° F. per minute over at least 600° F. temperature and a later second phase of temperature increase of 1-5° F. per minute over at least 100-300° F.

8. The method of claim 1 wherein:

the first temperature is 900-1100° F.; and the second temperature is 1800-2400° F.

9. The method of claim 1 wherein:

the heating in the oxidative atmosphere and the heating in the non-oxidative atmosphere are performed in a single chamber without intervening removal of the combination.

10. The method of claim 9 further comprising:

purging the oxidative atmosphere before the heating in the non-oxidative atmosphere.

11. The method of claim 10 wherein:

during the purging, an atmospheric temperature in the chamber does not drop by more than 50° F.

12. The method of claim 1 further comprising:

casting a metallic alloy in the shell; and destructively removing the shell from the alloy.

13. The method of claim 4 wherein:

the heating in the non-oxidative atmosphere comprises a first phase of temperature increase of 10-15° F. per minute over at least 600° F. temperature and a later second phase of temperature increase of 1-5° F. per minute over at least 100-300° F.

14. The method of claim 8 wherein:

the heating in the non-oxidative atmosphere comprises a first phase of temperature increase of 10-15° F. per minute over at least 600° F. temperature and a later second phase of temperature increase of 1-5° F. per minute over at least 100-300° F.

15. The method of claim 1 further comprising:

heating the shell to strengthen the shell.

16. The method of claim 15 further comprising:

cooling of the shell; and after the cooling of the shell, casting an alloy in the shell.

17. The method of claim 1 wherein:

a peak temperature of the heating the combination in the non-oxidative atmosphere is at least 800° F. at higher than a peak temperature of the heating the combination in the oxidative atmosphere.

18. The method of claim 7 wherein:

a peak temperature of the heating the combination in the non-oxidative atmosphere is at least 800° F. at higher than a peak temperature of the heating the combination in the oxidative atmosphere.

* * * * *